US006966202B2

(12) United States Patent
Okuno

(10) Patent No.: US 6,966,202 B2
(45) Date of Patent: Nov. 22, 2005

(54) METHOD OF KNITTING INTERSIA PATTERN KNITTED FABRIC

(75) Inventor: Masao Okuno, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/496,689

(22) PCT Filed: Nov. 22, 2002

(86) PCT No.: PCT/JP02/12247

§ 371 (c)(1),
(2), (4) Date: May 26, 2004

(87) PCT Pub. No.: WO03/046267

PCT Pub. Date: Jun. 5, 2003

(65) Prior Publication Data

US 2005/0016220 A1 Jan. 27, 2005

(30) Foreign Application Priority Data

Nov. 26, 2001 (JP) ..... 2001-359741

(51) Int. Cl.[7] ..... D04B 7/04
(52) U.S. Cl. ..... 66/64
(58) Field of Search ..... 66/127, 69, 128, 66/125, 179, 60 R, 60 H, 75.1

(56) References Cited

U.S. PATENT DOCUMENTS 4,905,483 A 3/1990 Shima
4,909,048 A * 3/1990 Stoll et al. ..... 66/127
5,379,615 A 1/1995 Shima
5,557,948 A * 9/1996 Shima et al. ..... 66/64
5,758,518 A * 6/1998 Shu et al. ..... 66/64
5,819,558 A 10/1998 Takegawa
6,047,570 A 4/2000 Shima

FOREIGN PATENT DOCUMENTS

JP 61-23300 B2 6/1986
JP 61-51061 B2 11/1986
JP 10-1852 A 1/1998
WO WO 02/97178 A1 12/2002

* cited by examiner

*Primary Examiner*—Danny Worrell
(74) *Attorney, Agent, or Firm*—Rothwell, Figg, Ernst & Manbeck, P.C.

(57) ABSTRACT

A method of knitting an intarsia pattern fabric that can prevent occurrence of a yarn catching even when a tubular knitted fabric with an intarsia pattern and the like is knitted by using a four-bed flat knitting machine and also can eliminate the need of a split knitting to provide improved productivity. The flat knitting machine has intarsia-pattern knitting function of allowing change of position of the knitting yarn fed from the yarn feeding member to a needle before or after the knitting of the intarsia pattern, and the knitted fabric opposite to the knitted fabric to be knitted to insert the intarsia pattern (3, 8) therein is knitted in such a condition that the knitting yarn (11) extending from a needle (K) holding a final loop of the intarsia pattern (3, 8) to the yarn feeder (10) of the yarn feeding member is hooked with an empty needle of the needle bed on the upper side of the needle bed to which the needle (K) belongs.

3 Claims, 5 Drawing Sheets

METHOD OF KNITTING INTERSIA PATTERN KNITTED FABRIC

CROSS REFERENCE TO RELATED APPLICATION

This application is a 35 USC § 371 National Phase Entry Application from PCT/JP02/12247, filed Nov. 22, 2002, and designating the U.S.

TECHNICAL FIELD

The present invention relates to a method of knitting an intarsia pattern knitted fabric in which an intarsia pattern is inserted in knitwear, such as a sweater, while the knitwear is knitted in the form of a seamlessly knitted tubular fabric by using a four-bed flat knitting machine.

BACKGROUND ART

In general, an intarsia pattern knitted fabric as shown in FIG. 5 is well known as a typical knitted fabric knitted by a flat knitting machine. FIG. 5(*a*) shows an example of a knitted fabric in which an intarsia pattern knitted fabric 3 of a diamond-shaped pattern is knitted in a part of a front body 2 of the sweater 1 and a grand pattern knitted fabric 4 is formed in the remaining part of the same. A back body opposite to the front body 2 is knitted in parallel with the front body and is jointed thereto at both ends thereof so that the sweater 1 is produced in the form of a seamlessly knitted tubular fabric. Rib knitted fabrics 5, which are called "the rib", are knitted at a bottom of the front body 2 and at a bottom of the back body, respectively. FIG. 5(*b*) shows an example of a knitted fabric in which an intarsia pattern knitted fabric 8 of a vertically-striped pattern is knitted in a part of a front body 7 of a sweater 6 and a grand pattern knitted fabric 9 is formed in the remaining part of the same.

FIG. 6 shows a needle arrangement for knitting the tubular knitted fabric incorporating the intarsia pattern knitted fabric 3, 8 as shown in FIG. 5 by the four-bed flat knitting machine. The basic structure of the four-bed flat knitting machine and the method of knitting the tubular knitted fabric by using it are disclosed by and are already known from e.g. JP Patent Publication No. Hei 1-57173 (corresponding U.S. Pat. No. 4,905,483) by the applicant of this application. The rib 5 of the front body is knitted with needles of a front lower needle bed (hereinafter it is referred to as "the needle bed FD") and needles of back upper needle bed (hereinafter it is referred to as "the needle bed BU"), and the rib of the back body is knitted with needles of a back lower needle bed (hereinafter it is referred to as "the needle bed BD") and needles of front upper needle bed (hereinafter it is referred to as "the needle bed FU").

When a course of the rib 5 of the front body is knitted, back stitches of the rib of the back body knitted with the needles of the needle bed FU are all transferred to the needles of the needle bed BD and held thereon. On the other hand, when a course of the rib 5 of the back body is knitted, back stitches of the rib of the front body knitted with the needles of the needle bed BU are transferred to the needles of the needle bed FD and held thereon. In short, when the front knitted fabric is knitted, the back knitted fabric is attached to needles of the needle bed BD, while on the other hand, when the back knitted fabric is knitted, the front knitted fabric is attached to needles of the needle bed FD, whereby the front knitted fabric and the back knitted fabric are knitted in an overlapped relation. The ribs 5 are formed in the tubular body in this manner. Following the ribs 5, the body is knitted with a plain-stitch structure requiring no stitch transference described above, and the front body is knitted with needles of the needle bed FD and the back body is knitted with needles of the needle bed BD. When a different knit structure, such as a links or a moved pattern, is inserted in the body, back stitches thereof are transferred by use of needles of the opposite upper needle bed in the same manner as in the knitting of the ribs 5 so that the knitting is performed with the stitch transference.

The intarsia pattern 3, 8 is knitted using a yarn feeding member, such as a yarn carrier (hereinafter it is simply referred to as "the carrier"), separate from the one used for the grand pattern knitted fabric 4, 9. The front body 2, 7 and the back body are knitted with the needles A, B, C, . . . of the lower needle beds indicated with capital alphabet letters. The needles a, b, c indicated with small alphabet letters are the needles of the upper needle beds. In the illustration, a knitting yarn of the intarsia pattern knitted fabric 3, 8 is indicated by a heavy line and a knitting yarn of the grant pattern knitted fabric 4, 9 is indicated by a thin line.

A plurality of yarn guide rails are suspended over the needle beds, though not shown, and a plurality of carriers are carried on the yarn guide rails in such a manner as to be slidable therealong. The carriers are moved by and are movable in association with cams provided in the carriage reciprocally movable over the needle beds so that the knitting yarn can be fed from a yarn feeder of the carrier to any needle on the needle bed. In each course knitted, the carrier used for knitting the intarsia pattern part 3, 8 is brought to standstill in the vicinity of a boundary between the intarsia pattern knitted fabric 3, 8 and the grand pattern knitted fabric 4, 9 until it is used again for knitting the intarsia pattern knitted fabric 3, 8 in the next course. In other words, separate carriers are used for knitting the neighboring knitted fabrics confronting each other across the boundary therebetween. Due to this, the carriers are intricately interrelated in the vicinity of the boundary between the intarsia pattern knitted fabric 3, 8 and the grand pattern knitted fabric 4, 9. This causes possible problems of interference of the adjoining yarn feeders of the carriers; abutment of a front end of a needle which is brought into knitting action with the carrier which is in the resting state; and a yarn catching problem that when the grand pattern knitted fabric 4, 9 adjacent to the intarsia pattern knitted fabric 3, 8 is knitted, a knitting yarn extending from a final loop of the intarsia pattern knitted fabric 3, 8 to the yarn feeder of the carrier which is in the resting state may be caught in by a front end of a needle.

Consideration has been made of an intarsia-pattern-knitting carrier capable of forcing the yarn feeder of the carrier to swing and shift back and forth with respect to a traveling direction thereof when the intarsia pattern knitted fabric is knitted. For example, the applicant of this application discloses in JP Patent Publication No. Sho 61-51061 a carrier that can force the yarn feeder of the carrier to swing and shift so that the knitting yarn can be extended substantially vertically from the final loop when the carrier is put in the resting state and a method of knitting an intarsia pattern using the same carrier. By using this carrier capable of shifting the yarn feeder, a plurality of intarsia patterns can be inserted in a course when knitted with the carriage having a plurality of cam systems. JP Patent Publication No. Sho 61-23300 discloses a related art that lower end portions of the carriers having yarn guidable holes are vertically shifted from each other projecting into a space between adjacent needles, thereby avoiding the interference of the carriers.

The applicant of this application previously proposed in JP Laid-open (Unexamined) Patent Publication No. Hei 10-1852 a method of knitting an intarsia pattern knitted fabric inserting the intarsia pattern therein, while knitwear, such as a sweater, is knitted in the form of a tubular knitted fabric. The publication discloses two optional ways as the method of knitting a tubular knitted fabric in which the intarsia pattern is designed in the front knitted fabric. It discloses in FIG. 2 a first embodiment wherein when the back body having no intarsia pattern is knitted in the back needle bed, the respective carriers are reversed whenever they reach boundaries of the intarsia pattern of the front body, so that the back body is knitted in a divisive manner to prevent an interference of the carriers and an unwanted yarn catching. Specifically, when a course of the back body at its grand pattern part opposite to the intarsia pattern is knitted, the following two steps are taken: a) after the carrier for intarsia pattern use is kicked back and shifted to a position within an intarsia pattern region, the grand pattern part is knitted up to near the intarsia pattern, and b) after the carrier for intarsia pattern use and the carrier for grand pattern use are kicked back and shifted to a position outside of an intarsia pattern region, the remaining grand pattern part is knitted. It also shows in FIG. 3 a second embodiment wherein when the back body is knitted, the carrier as was used for knitting the intarsia pattern of the front body is moved back to a position outside of the entire width of the knitted fabric, to prevent the interference and the unwanted yarn catching.

In the first embodiment disclosed by JP Laid-open (Unexamined) Patent Publication No. Hei 10-1852, the shuttle knitting is performed when the back body is knitted. As described in the publication at paragraph [0011], the shuttle knitting involves the problem that the stitches become dense at locations between which the carriers are shuttled, causing disfigurement of the knitted fabric. This problem can be dealt with by decreasing the density of the stitches formed with the needles at the reversing positions, but the adjustment of the stitch density is complex, taking a lot of time and labor. In addition, since the back body must be knitted in a divisive manner, rather than in a single dash, the productivity is reduced. In the second embodiment, there is no need to do the shuttle knitting, but it is necessary that the knitting yarn is fed to the yarn feeding member from directly above, as described in the publication at paragraph [0012]. Thus, limitation is put on the method of yarn feeding, putting limitation on the number of yarn carries used.

Using the carrier for intarsia-pattern use as disclosed by JP Patent Publication No. Sho 61-51061 can relax the limitations on the number of yarn carriers used and on the method of yarn feeding. It can also eliminate the need of doing the shuttle knitting, thus eliminating the need of adjustment of the stitch density at the boundaries of the intarsia pattern. However, it is found that the unwanted yarn catching problem involved in the knitting of the tubular knitted fabric mentioned above is not always solved by it. This is because even the carrier having the yarn feeder of changeable in position cannot always be stopped at the boundaries of the intarsia pattern with sufficient accuracy.

FIG. 7 shows the state in which the final loop of the intarsia pattern is formed, for example, by a needle K of the needle bed FD, and a yarn feeder 10 of the carrier is in the resting state. In FIG. 7, for the purpose of better understanding, the needles of the upper needle beds and those of the lower needle beds illustrated are shifted in phase so that they are made visible in the drawing. But, in the actual knitting machine, the upper needles and lower needles put on their respective needle beds are respectively common in phase with respect to a longitudinal direction of the needle beds. New loops of the intarsia pattern are formed from a knitting yarn 11 by needles K, L, M and old loops 14 are knocked over therefrom. When the yarn feeder 10 of the carrier is stopped at a position within the range of A, the unwanted yarn catching problem that the knitting yarn 11 extending from the needle K of the needle bed FD to the yarn feeder 10 is caught in by a needle of the needle bed BD does not incur. Although the range of A is extended to a position slightly beyond a needle J of the needle bed BD owing to a level difference between the yarn feeder 10 and the needle K, it is hard to always stop the yarn feeder 10 at a position within the range of A, in view of the stopping accuracy. A carrier of the type movable with and by a fetching pin provided in the carriage is designed to stop partway along the length of the yarn guide rail when the fetching pin is disengaged from a catching pin. The carrier and the yarn guide rail are required to have properties to satisfy a hard-to-exist-together relation that when the carrier is moved together by the carriage, a small sliding resistance is provided between the carrier and the yarn guide rail so that the carrier can move smoothly, while on the other hand, when the carrier is not moved together by the carriage, a resistance able to make the carrier hard to move is provided therebetween. The carrier and the yarn guide rail can be lubricated with oil and the like to provide a reduced sliding resistance, while on the other hand, adsorptive power of magnet can be used to provide enhanced braking performance. Nevertheless, it is hard to provide highly improved stopping accuracy of the yarn carrier. Due to this, there is the possibility that the yarn feeder cannot be stopped at a position within the range A where the unwanted yarn catching does not occur easily or can be stopped at a position outside of the range A where the unwanted yarn catching occurs easily.

It is an object of the present invention to provide a method of knitting an intarsia pattern knitted fabric that can prevent occurrence of an unwanted yarn catching even when a tubular knitted fabric with an intarsia pattern and the like is knitted by using a four-bed flat knitting machine and also can eliminate the need of the shuttle knitting described above to provide improved productivity.

DISCLOSURE OF THE INVENTION

The present invention provides a method of knitting an intarsia pattern knitted fabric inserting the intarsia pattern therein by using a four-bed flat knitting machine comprising a pair of lower needle beds placed in front and back and a pair of upper needle beds placed over the lower needle beds, respectively, wherein a tubular knitted fabric whose front knitted fabric part and back knitted fabric part are joined together at both side ends thereof in an overlapped relation is knitted in such a manner that when the front knitted fabric is knitted, the back knitted fabric is attached to needles of the back lower needle bed, while on the other hand, when the back knitted fabric is knitted, the front knitted fabric is attached to needles of the front lower needle bed by using a plurality of yarn feeding members to discharge and feed knitting yarns from their yarn feeders to needles while traveling in a longitudinal direction of the needle beds, wherein the flat knitting machine has intarsia-pattern knitting function of allowing change of position of the knitting yarn fed from the yarn feeding member to a needle before or after the knitting of the intarsia pattern and wherein the knitted fabric opposite to the knitted fabric to be knitted to insert the intarsia pattern therein is knitted in such a condition that the knitting yarn extending from a needle of the lower needle bed holding a final loop of the intarsia pattern to the yarn feeder of the yarn feeding member is hooked with a needle of the upper needle bed on the side on which the needle bed to which the needle belongs is placed and then is kept away from the needle of the needle bed on the opposite side. According to this construction, when the knitted fabric opposite to the knitted fabric to be knitted to insert the intarsia pattern therein is knitted, the knitting yarn used for knitting the intarsia pattern and extending from the yarn feeder of the carrier which is in the resting state around the boundaries of the intarsia pattern to a needle holding a final loop of the intarsia pattern is hooked with an empty needle of the needle bed on the upper side of the needle bed to which the needle belongs. As a result of this, the knitting yarn extending from the final loop of the intarsia pattern to the yarn feeder is retracted to a position away from the needle of the opposite needle bed. Therefore, even when the needles for knitting the knitted fabric on the opposite needle bed are moved back and forth to form knitting loops, the knitting yarn of the intarsia pattern can be prevented from being caught mistakenly by those needles. As a result, the need of the conventional shuttle knitting to knit divisively in the vicinity of the boundaries of the intarsia pattern can be eliminated, providing improve quality of knitted fabric and reduced production cost.

It is preferable that the needle of the upper needle bed used to hook the knitting yarn is a needle located directly above or in the vicinity of the needle of the lower needle bed holding the final loop. According to this construction, the knitting yarn is limited in extension range to around the needle holding the final loop, thus preventing the unwanted yarn catching efficiently.

It is preferable that when the knitted fabric opposite to the knitted fabric inserting the intarsia pattern therein is knitted using carriages each having at least two sets of cams to force the respective needles of the needle beds to operate to knit, the hooking of the knitting yarn extending from the needle holding the final loop of the intarsia pattern to the yarn feeder of the yarn feeding member with an empty needle and the release of the hooked knitting yarn therefrom are alternately performed. For example, after the knitting yarn extending from the needle of the lower needle bed holding the final loop of the intarsia pattern to the yarn feeder of the yarn feeding member is hooked with an empty needle of the upper needle bed on the same side as the lower needle bed and then is retracted by the leading side cam, the knitted fabric opposite to the knitted fabric inserting the intarsia pattern therein is knitted by a sequent trailing cam. After the knitted fabric opposite to the knitted fabric inserting the intarsia pattern therein is knitted via the leading cam, the hooked knitting yarn is released from the needle by moving the needle hooking the yarn back and forth via the trailing cam. This can provide enhanced productivity in knitting the knitted fabric.

BEST MODE FOR CARRYING OUT THE INVENTION

Figure 1:
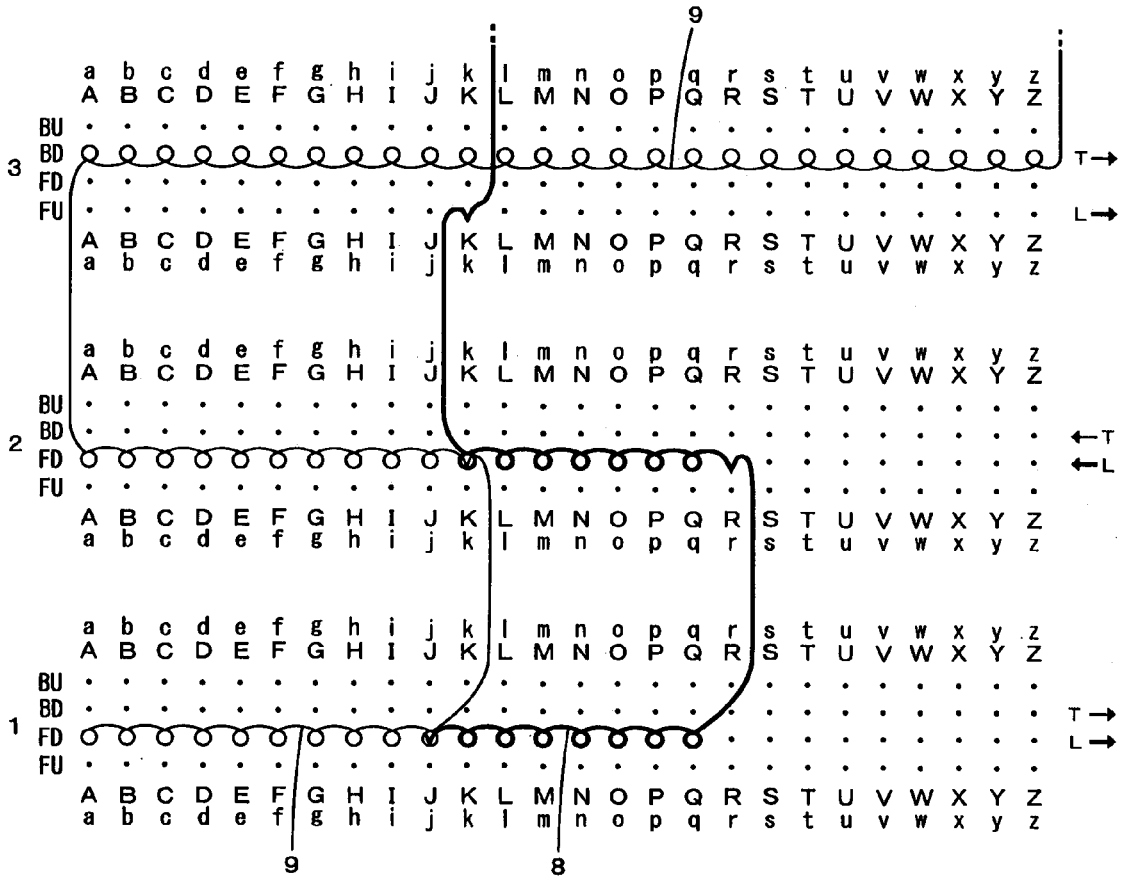
FIG. 1 shows a first half of the knitting of a tubular knitted fabric having an intarsia pattern taken as an example of the present invention.
Figure 2:
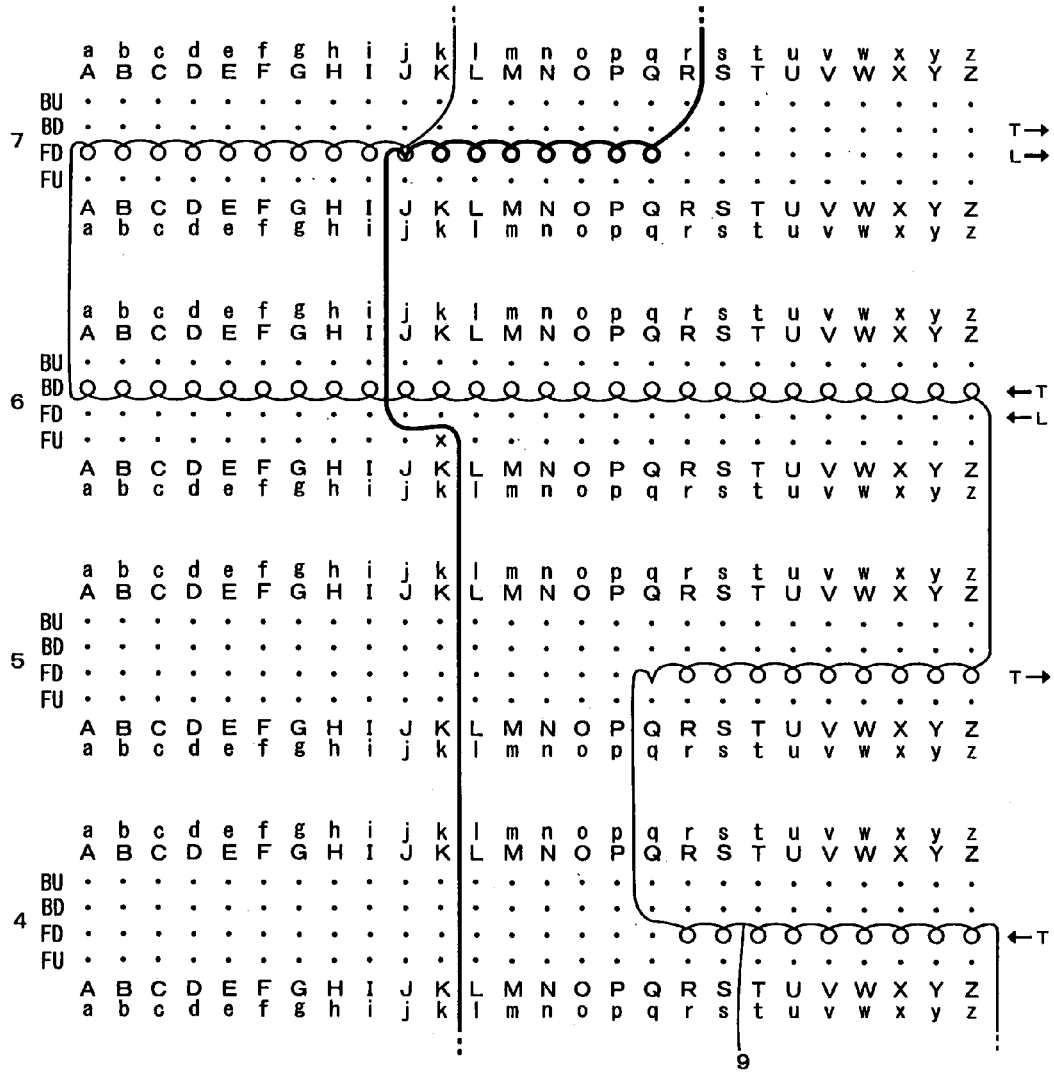
FIG. 2 shows a second half of the knitting of the tubular knitted fabric having the intarsia pattern sequent to the knitting of FIG. 1.
Figure 5:
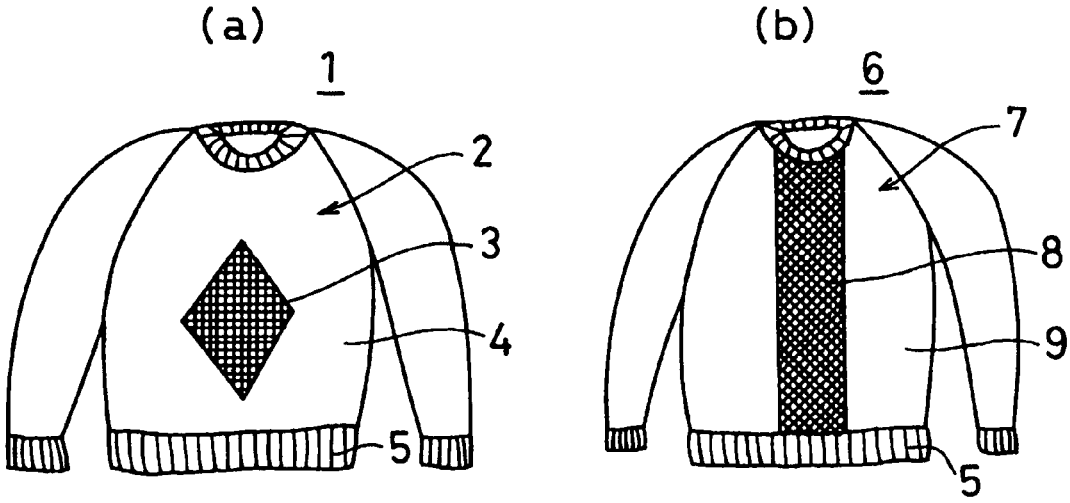
FIG. 5 shows appearances of tubular knitted fabrics having intarsia patterns, respectively.

In the following, certain preferred embodiments of the present invention will be described with reference to the accompanying drawings. FIGS. 1 and 2 show the knitting diagram for knitting a body of an intarsia pattern sweater shown in FIG. 5 knitted into a tubular form by using a four-bed flat knitting machine. For explanatory convenience, a reduced number of needles used for knitting the respective parts of the body are shown. Capital alphabet letters indicate needles of lower needle beds, and small alphabet letters indicate needles of upper needle beds. A front body and a back body which are continuous with the rib 5 are both knitted with a plain-stitch structure. The front body is knitted with the needles A, B, C, D, . . . of the needle bed FD, and the back body is knitted with the needles A, B, C, D, . . . of the needle bed BD. A vertically-striped pattern as shown in FIG. 5(*b*) is taken here as an example of the intarsia pattern.

A carriage capable of forcing two sets of cams to act on the respective needle beds is used. A cam located on a leading side when the carriage travels to one side is expressed as an L-side cam and another cam located on a trailing side is expressed as a T-side cam. When the carriage travels to the other side, the leading side and the trailing side of the cam are switched with each other. The carrier of the same swinging type as the type one disclosed by e.g. JP Patent Publication No. Sho 61-51061 is used. In this embodiment, six courses of courses 1–6 depicted are taken as one cycle of movements of the carriage, and two courses of the tubular knitted fabric can be knitted on the one cycle of movement of the carriage. It is to be noted that the needle beds mount compound needles thereon.

In the first course of movement of the carriage, the carriage is shifted from the left end partway along the course to the right end, while the L-side cam is used to knit an intarsia pattern of the front body with needles K, L, . . . P, and Q on the needle bed FD and the T-side cam is used to knit a left-side part of a grant pattern of the front body with needles A, B, . . . , I, and J on the needle bed FD. A left end of the knitting yarn for the intarsia pattern knitting is tucked and connected to the needle J located at the right end of the left-side part of the ground pattern. The first course of the intarsia pattern and the left-side part of the grand pattern is knitted in this manner.

In the second course of movement of the carriage, the carriage is shifted from partway of the course on the right side to the left end, while the L-side cam is used to knit the intarsia pattern of the front body with the needles Q, P, . . . L, and K and the T-side cam is used to knit the left-side part of the grant pattern of the front body with the needles J, I, . . . , B, and A. A right end of the knitting yarn for knitting the intarsia pattern is tucked and connected to the needle R located at the left end of the right-side part of the ground pattern. A right end of the knitting yarn for the left-side part of the grand pattern knitting is tucked and connected to the needle L located at the left end of the intarsia pattern. The second course of the intarsia pattern and the left-side part of the grand pattern is knitted in this manner.

In the third course, the carriage is shifted rightward and the carrier is shifted to the right side of the needle K by the L-side cam. Also, the L-side cam is used to force an empty needle k of the needle bed FU to hook the knitting yarn extending from the needle K located at the left end of the intarsia pattern to the yarn feeder of the carrier, and the T-side cam is used to feed a knitting yarn to the needles A, B, . . . , Y, and Z of the needle bed BD to knit the back body. After hooking the knitting yarn, the empty needle k of the needle bed FU is retracted deeply from a needle bed gap so that the knitting yarn extending to the yarn feeder of the carrier is kept away from the needle bed gap. This motion is provided by increasing the setting of retraction of a stitch cam or by retracting the needle forcibly via a retracting cam on the upper carriage. This can surely prevent the knitting yarn from the carrier used for the intarsia pattern knitting from being caught mistakenly by the needle used for forming the stitches of the back body. When the back body is knitted via the T-side cam, the knitting yarn from the needle K of the needle bed FD located at the left end of the intarsia pattern is extended to the yarn feeder of the carrier through the needle k of the needle bed FU. This can make the unwanted yarn catching hard to occur even when there is variation in stopping accuracy of the carrier. The first course of the grand pattern of the back body is knitted in this manner.

In the fourth course of movement of the carriage, the carriage is shifted from the right end partway along the course to the left end, while the T-side cam is used to knit a right-side part of the grand pattern of the front body with needles Z, Y, . . . S, and R on the needle bed FD. In the fifth course of movement of the carriage, the carriage is shifted from partway of the course on the left side to the right end, while the T-side cam is used to knit the right-side part of the front body with the needles R, S, . . . Y, and Z. A left end of the knitting yarn for knitting the right-side part of the grand pattern of the front body is tucked and connected to the needle Q located at the right end of the intarsia pattern. The first course and the second course of the right-side part of the grand pattern of the front body are knitted in this manner.

In the sixth course of movement of the carriage, the carriage is shifted from the right end to the left end, while the L-side cam is used to knit the grand pattern of the back body with needles Z, Y, . . . B, and A. The T-side cam is used to shift the carrier to the left side of the needle k and also move the needle k of the needle bed FU back and forth, so as to release the hooked knitted yarn from that needle. After the second course of the grand pattern of the back body is knitted in this manner, the knitting yarn hooked with the needle k of the needle bed FU is released therefrom.

Figure 3:
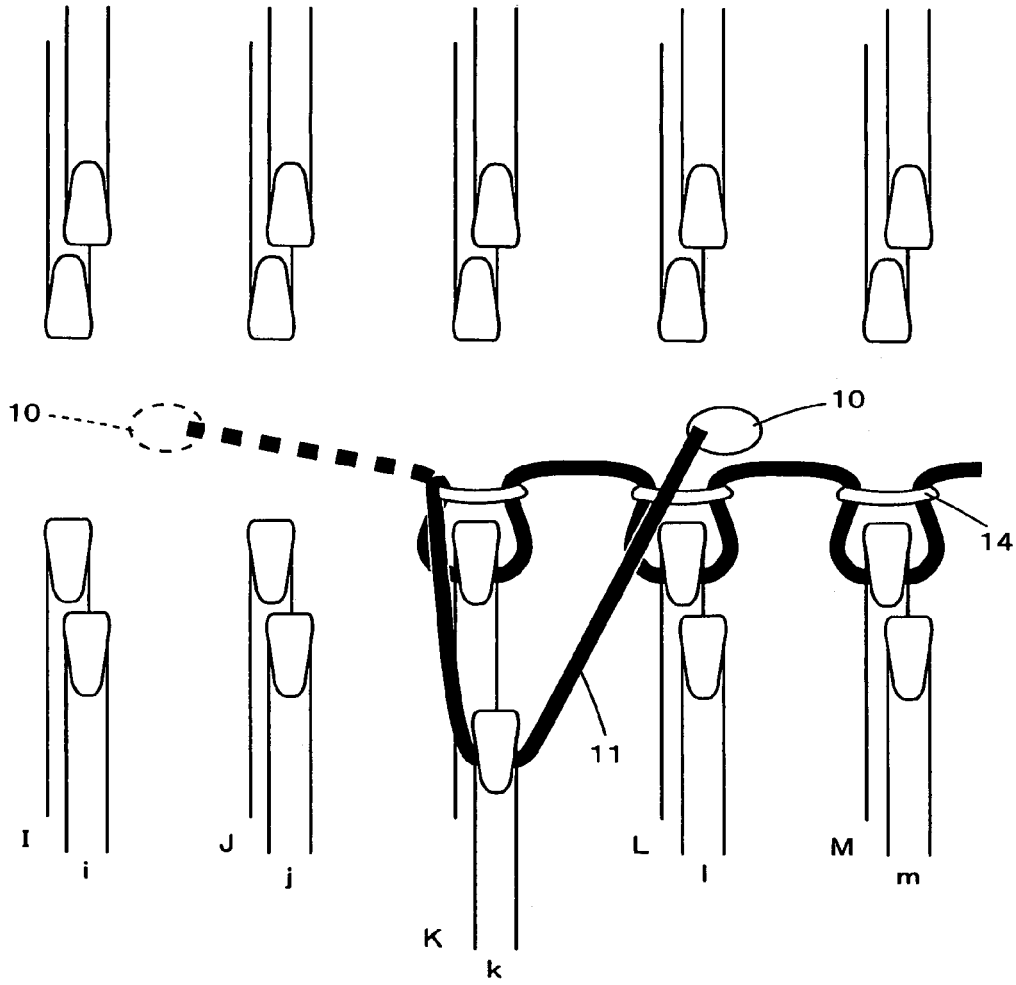
FIG. 3 is a partial plan view showing the state in which a knitting yarn is hooked by needles of the front upper needle bed in the third course of FIG. 1 along which the carriage is moved.
Figure 4:
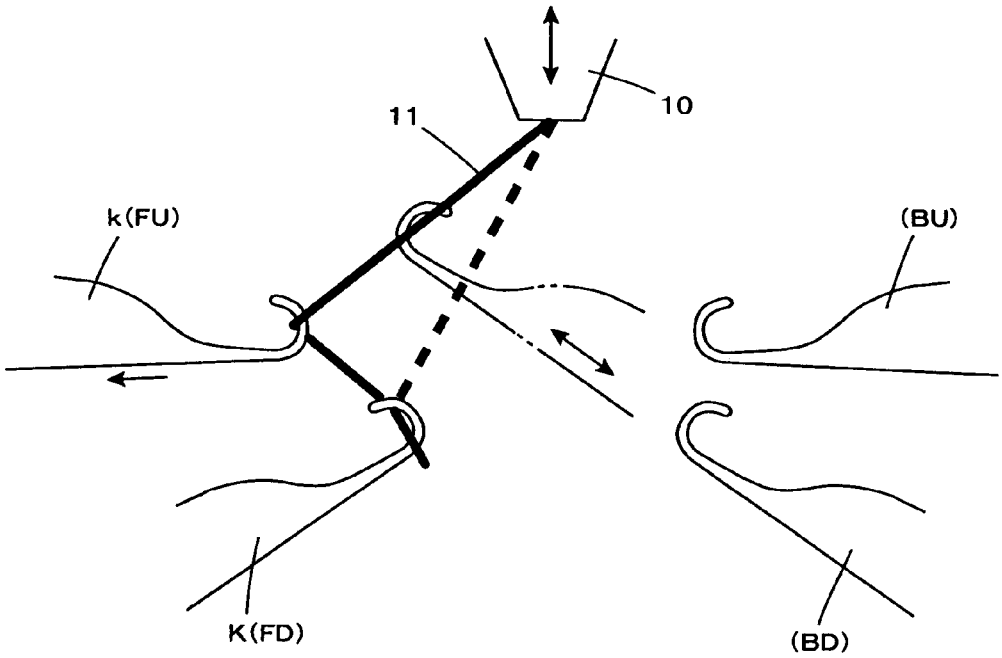
FIG. 4 is a right side view of FIG. 2.
Figure 6:
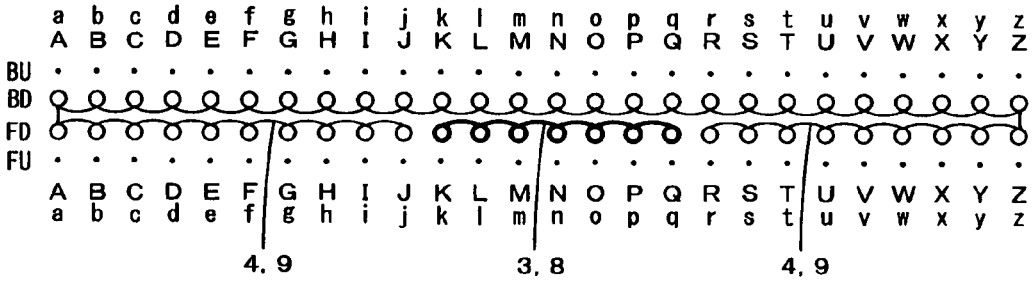
FIG. 6 shows the state of the needles used when the tubular knitted fabric of FIG. 4 is knitted by using a four-bed flat knitting machine.
Figure 7:
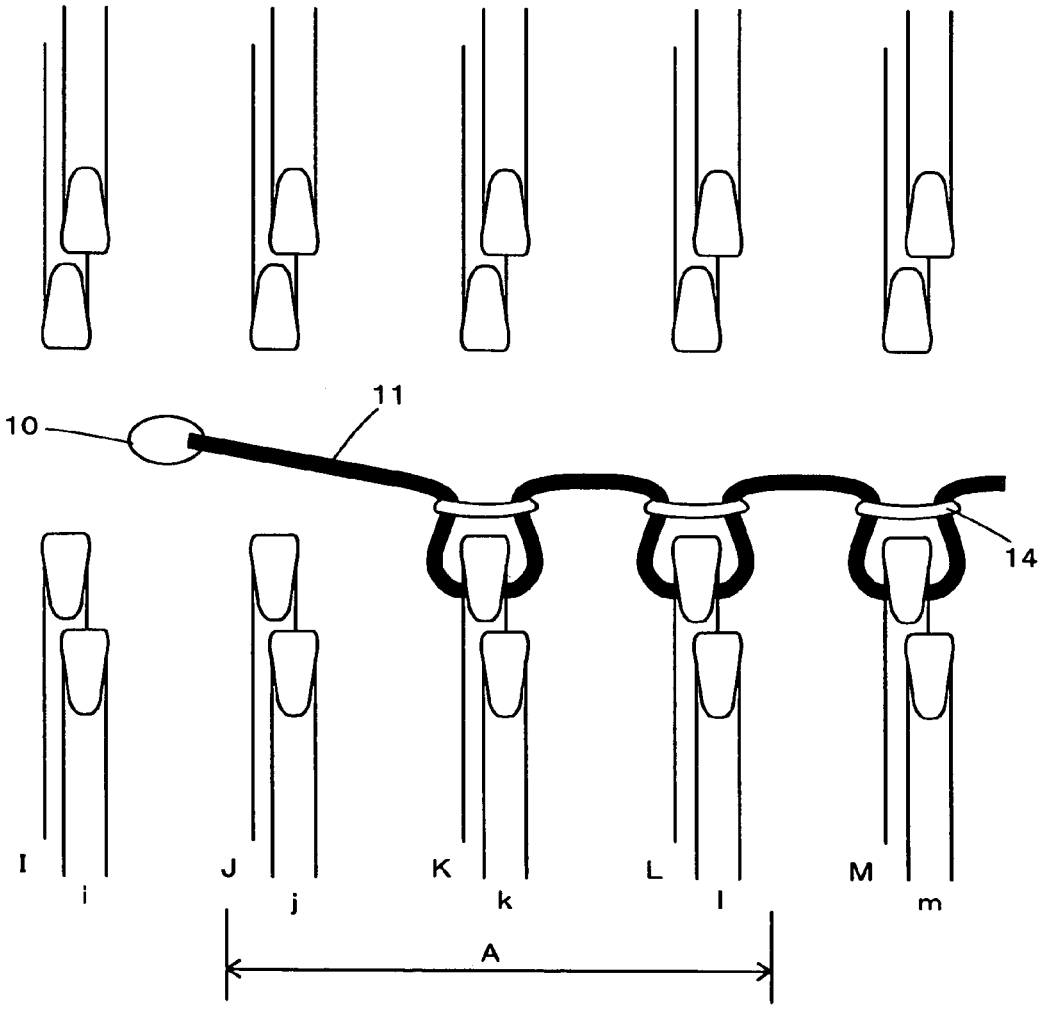
FIG. 7 is a partial plan view showing a range within which no yarn catching is produced by using a carrier.

FIGS. 3 and 4 are illustrations illustrating that when the back body is knitted, the knitting yarn for the intarsia pattern knitting is prevented from being caught in the needle of the needle bed BD. In FIG. 3, the needles of the upper needle beds and those of the lower needle beds are shifted in phase so that they are made visible in the drawing, as is the case with the FIG. 6. As shown in FIG. 3, in the third course of movement of the carriage shown in FIG. 1, the knitting yarn 11 extending from the needle K located at the left end of the intarsia pattern knitted on the needle bed FD to the yarn feeder 10 of the carrier, indicated by a dotted line, is hooked with the empty needle k of the needle bed FU in association with the kick-back motion of the carrier and then the empty needle k is retracted deeply, as indicated by a solid line. This makes it hard for the knitting yarn 11 extending from the needle k of the needle bed FU to the yarn feeder 10 to be hooked by a needle on the needle bed BD side, indicated by a phantom line, when moved forward to the needle bed gap, as shown in FIG. 4. If the knitting yarn is extended from the needle K of the needle bed FD to the yarn feeder 10, as indicated by a dotted line, then it will be easily drawn in by the needle which moves to the needle bed gap from the needle bed BD. In this embodiment, this difference can result in the prevention of occurrence of the unwanted yarn catching. By repetition of the above knitting of the courses 1–6 of the carriage, the intarsia pattern can be formed in the tubular knitted fabric.

(Variant)

In the above knitting, in the third course of movement of the carriage, the carriage is kicked back rightward and the L-side cam is used to force the carrier to move to the right side of the needle K and also force the empty needle k of the needle bed FU to hook the knitting yarn extending from the needle K at the left end of the intarsia pattern to the yarn feeder of the carrier. Then, in the sixth course of movement of the carriage, the T-side cam is used to kick back the carrier to move it to a position at the left side of the needle k and also force the needle k of the needle bed FU to move back and forth so as to release the hooked knitting yarn from the needle. This may be substituted for the following construction to practice the invention.

Specifically, in the second course of movement of the carriage, the carriage is shifted from right to left and the L-side cam is used to knit the intarsia pattern part of the front body with the needles Q, P, . . . , L, and K of the needle bed FD and also force the empty needle j of the needle bed FU to hook the knitting yarn. This needle of the needle bed FU used to hook the knitting needle is a needle located at least directly above, or outside of and in the vicinity of the needle J of the needle bed FD where the knitting yarn is tucked and connected in the seventh course where the next intarsia pattern part is knitted. Then, the T-side cam is used to knit the left-side part of the grand pattern along the needles J, I, . . . B, and A. In this course, the tucking for connecting the intarsia pattern part and the grand pattern part is performed with the needles R, L in the same manner as in the above case.

In the sequent third to fifth courses, the same knitting is performed as in the above case. Thereafter, in the sixth course of movement of the carriage, while the carriage is shifted from right to the left end, the L-side cam is used to knit the grand pattern part of the back body along the needles Z, Y, . . . B, and A and also the T-side cam is used to force the needle j of the needle bed FU to move back and forth so as to release the knitting yarn from the needle j. Then, in the seventh course, the same knitting is performed as in the above case. This method can omit the kick-back motion of the carrier described above or the motion that the carrier used for knitting the intarsia pattern part is shifted right and left so that the empty needle of the needle bed FU is forced to hook the knitting yarn and then release it therefrom. In the case where the hooking of the knitting yarn in the second course by using the needle of the needle bed FU and the tucking connection in the seventh course by using the needle of the needle bed FD are taken place via the needles different in phase from each other (e.g. needles i and J), the release of the knitting yarn and the tucking may be taken place simultaneously when the intarsia pattern part in the seventh course is knitted via the L-side cam, without the release of the knitting yarn being taken place in the sixth course.

When intarsia patterns, e.g. diamond-shaped patterns, are arranged along a lateral direction, the plurality of carriers may be put in the resting state at closely. In this case, the empty needle to hook the yarn should preferably be selected to increase the distance between the carriers as much as possible.

The term "tubular knitted fabric" here in the present invention is intended to include not only a complete tubular knitted fabric whose front and back bodies are joined together at both knitting-width ends thereof but also a knitted fabric which is knitted with its front and back bodies partially split off, such as a cardigan. The present invention is also applicable to this partially split tubular knitted fabric having the intarsia pattern, enabling this intarsia pattern tubular fabric to be knitted with efficiency.

According to the present invention, a knitted fabric having an intarsia pattern whose knitting width gradually increases and then gradually decreases, such as the intarsia pattern knitted fabric 3 of diamond-shaped pattern as shown in FIG. 5(*a*), can be knitted. When the intarsia pattern whose knitting width varies drastically is knitted in the front body, it can be knitted in the following manner. The front body is finished knitting in the manner as described above, first, and, then, the back body is knitted in that state and immediately before the next course, is knitted while tucking forward to the starting point of the course.

A strip-shaped part of the intarsia pattern 8 of FIG. 5(*b*) may be knitted in the form of a knitted fabric part with button holes of the cardigan by using a substitute knitting yarn to reinforce the intarsia pattern part than the remaining part of the knitted fabric. This part of the knitted fabric is knitted by using a carrier separate from that for the other knitted fabric part. Due to this, it is necessary that the carriers are rested at its boundaries and the unwanted yarn catching is prevented when the opposite knitted fabrics are knitted. Even for a variant of the tubular knitted fabric wherein its knitted fabrics parts are partially opposite to each other due to a pocket and the like, the present invention is also applicable to such partially opposite parts. As described above, the intarsia pattern parts the present invention include not only the knitted fabric part knitted in the form of decoration but also the knitted fabric part knitted with a substitute yarn requiring that the carriers should be rested at its boundaries when the opposite knitted fabrics are knitted. Further, the present invention is also applicable to the tubular knitted fabric having the intarsia pattern at its back side only, as well as to the tubular knitted fabric having the intarsia patterns at both sides thereof.

Although the example employing the swinging carrier to force the yarn feeder of the carrier to shift in position in a swinging manner as the function of knitting the intarsia pattern has been illustrated above, the present invention can be practiced in substantially the same way, as long as it has the function of forcing the yarn feeder of the carrier to move vertically and horizontally. It is needless to say that the present invention may be made without departing from the spirit and the scope of the invention. For example, the present invention is applicable to combination of a vertically movable carrier with a flat knitting machine having the structure wherein a steel plate used to kick back the carrier is constructed in the yarn guide rail and is driven laterally by a motor, as described in JP Patent No.2903152 (corresponding U.S. Pat. No. 6,047,570), for example.

What is claimed is:

1. A method of knitting an intarsia pattern knitted fabric with a four-bed knitting machine, said knitting machine comprising a pair of lower needle beds including front and back needle beds and a pair of upper needle beds placed over the lower needle beds, respectively, the flat knitting machine having an intarsia-pattern knitting function of allowing change of position of the knitting yarn fed from a yarn feeding member to a needle before or after the knitting of the intarsia pattern, said method comprising the steps of:

knitting a tubular knitted fabric whose front knitted fabric part and back knitted fabric part are joined together at both side ends thereof in an overlapped relation in such a manner that when the front knitted fabric is knitted, the back knitted fabric is attached to needles of the back lower needle bed, and when the back knitted fabric is knitted, the front knitted fabric is attached to needles of the front lower needle bed by using a plurality of yarn feeding members to discharge and feed knitting yarns from their yarn feeders to needles while traveling in a longitudinal direction of the needle beds and knitting one of the front knitted fabric or the back knitted fabric which opposes the knitted fabric into which the intarsia pattern is knitted, such that the knitting yarn extending from a needle of the lower needle bed holding a final loop of the intarsia pattern to the yarn feeder of the yarn feeding member is hooked with a needle of the upper needle bed on the side on which the needle bed to which the needle belongs is placed and then is kept away from the needle of the needle bed on the opposite side.

2. The method of knitting an intarsia pattern knitted fabric according to claim 1, wherein the needle of the upper needle bed used to hook the knitting yarn is a needle located directly above or in the vicinity of the needle of the lower needle bed holding the final loop.

3. The method of knitting an intarsia pattern knitted fabric according to claim 1, wherein said knitting of said one of the front knitted fabric or the back knitted fabric is knitted using carriages each having at least two sets of cams to force the respective needles of the needle beds to operate to knit, and further comprising steps of:

alternately performing the hooking of the knitting yarn extending from the needle holding the final loop of the intarsia pattern to the yarn feeder of the yarn feeding member with an empty needle and the releasing of the hooked knitting yarn therefrom.

* * * * *